US005901375A

United States Patent [19]

Davis

[11] Patent Number: 5,901,375

[45] Date of Patent: May 11, 1999

[54] MULTI-USE CONVERTIBLE GARMENT

[76] Inventor: Burl W. Davis, 820 North Lydia, Stephenville, Tex. 76401

[21] Appl. No.: 09/122,023

[22] Filed: Jul. 24, 1998

[51] Int. Cl.[6] ..... A41D 1/00

[52] U.S. Cl. ..... 2/84; 2/69; 2/69.5

[58] Field of Search ..... 2/84, 69, 69.5, 2/85, 88, 89, 93, 94, 108; 383/4

[56] References Cited

U.S. PATENT DOCUMENTS

| | | | |
|---|---|---|---|
| D. 338,586 | 8/1993 | Dolan | D6/596 |
| D. 390,057 | 2/1998 | Gower | D6/598 |
| 2,024,044 | 12/1935 | Johnson | 2/88 |
| 2,058,474 | 10/1936 | Long | 2/85 |
| 2,462,269 | 2/1949 | Krempel | 2/88 |
| 2,717,437 | 9/1955 | Mestral | 28/72 |
| 3,522,612 | 8/1970 | Palmer | 2/88 |
| 4,078,264 | 3/1978 | DeGennaro et al. | 2/88 |
| 4,183,111 | 1/1980 | Zahavkochav | 5/343 |
| 5,787,504 | 8/1998 | Wu | 2/93 |

FOREIGN PATENT DOCUMENTS 9-13209 1/1997 Japan .

9-28536 2/1997 Japan .

OTHER PUBLICATIONS

Instructions for Making the Magic Pillow; Fabri–Quilt, 901 East 14th Avenue, North Kansas City, MO 64116.

Making E&P Sewing's Magic Pillow Quilt; E&P Sewing, 135 N. Main, Gunnison, Colorado 81230.

Quillows; (Australian) Internet address: http://www.nactx-.com/country/quillow.htm.

*Primary Examiner*—Diana L. Biefeld

*Attorney, Agent, or Firm*—Gardere & Wynne, L.L.P.

[57] ABSTRACT

A multi-purpose garment has an elongated, rectangular first sheet. The first sheet has an inside surface, an outside surface, a pair of short sides and a pair of long sides. A hood has a bottom edge attached at a central position along one of the long sides of the first sheet. A first pocket is disposed on the inside of the first sheet and opens towards the hood at a central position along the one long side of the first sheet. The first pocket is positioned and sized to receive the hood folded therein. A reversible second pocket is disposed on the outside of the first sheet and opens away from the hood at a central position along the one long side of the first sheet and the second pocket is sized to receive the first sheet folded therein.

13 Claims, 3 Drawing Sheets

MULTI-USE CONVERTIBLE GARMENT

FIELD OF THE INVENTION

This invention relates to a fabric garment capable of serving several functions, each function of which normally requires a separate article of manufacture. More particularly, the invention provides a fabric garment which is suitable for use as either a pillow, cushion, blanket, or hooded wrap, depending only upon the desire of the user at any given time.

BACKGROUND OF THE INVENTION

Comfort items such as pillows, cushions, blankets, hooded body wraps and ponchos have been in popular use, particularly at outdoor sports events, for quite some time. Clearly, for attendees of outdoor events it is desirable to have at hand items which provide as high a degree of comfort as possible for a given situation. However, owing to the constraint of the capacity of the average individual traveling on foot to carry a volume of items on their person to and from a location at which an outdoor event is held, it is more often the case that not that event attendees find themselves with fewer items of comfort than desires. That is, most persons find themselves in want of one or more of the above-mentioned comfort items at any particular time.

The prior art in the area of convertible comfort articles includes several items which purport to provide items having varied utility. These include the items set forth in U.S. Pat. Nos. 1,839,000; 1,901,223; 2,408,662; 2462,269; 2,513,074; 2,870,464; 2,971,198; 3,522,612; 4,078,264; and Des. 338,586. However, none of the prior art devices provide a hooded body wrap which is readily converted into a cushioning device, the same device which may also be readily converted into a blanket. Further, none provide a cushion which may be converted into a body wrap or blanket at a cost which is effective for permitting widespread use of such item by persons of only modest income. Therefore, it is desirable to provide a fabric garment which is capable of functioning as a blanket, hooded body wrap, and cushion or pillow wherein the item may be readily converted from one of these forms to another, conveniently and in a minimum amount of time.

SUMMARY OF THE INVENTION

The present invention provides a hooded body wrap which is readily converted into a blanket or pillow by an individual. It is comprises an elongated, rectangular first sheet having an inside, an outside, two short sides, a first long side and a second long side and also a hood attached at a central position on the first long side of the first sheet. There is also a first pocket disposed on the inside of the first sheet and opening towards the hood at a central position along the first long side of the first sheet, wherein the first pocket is positioned and sized to receive the hood when the hood is folded therein. In addition, there is a second pocket disposed on the outside of the first sheet and opening away from the hood at a central position along the one long side of the first sheet, and the second pocket is sized to receive the first sheet folded therein.

BRIEF DESCRIPTION OF THE DRAWINGS

The apparatus of the present invention is further described and explained in relation to the following figures of the drawings wherein.

Like reference numerals are used to indicate like parts in all figures of the drawings.

DETAILED DESCRIPTION OF THE PREFERRED EMBODIMENT

Referring now to FIGS. 1 through 4, the present invention is a fabric garment 16 which is convertible between various utilities as a hooded body wrap, cushioning device, and blanket. The garment 16 comprises, in its simplest form, a rectangular sheet of fabric having two faces, each face having a pocket or plurality thereof sewn in positions we have discovered to provide the synergy displayed by the garment.

Figure 1:
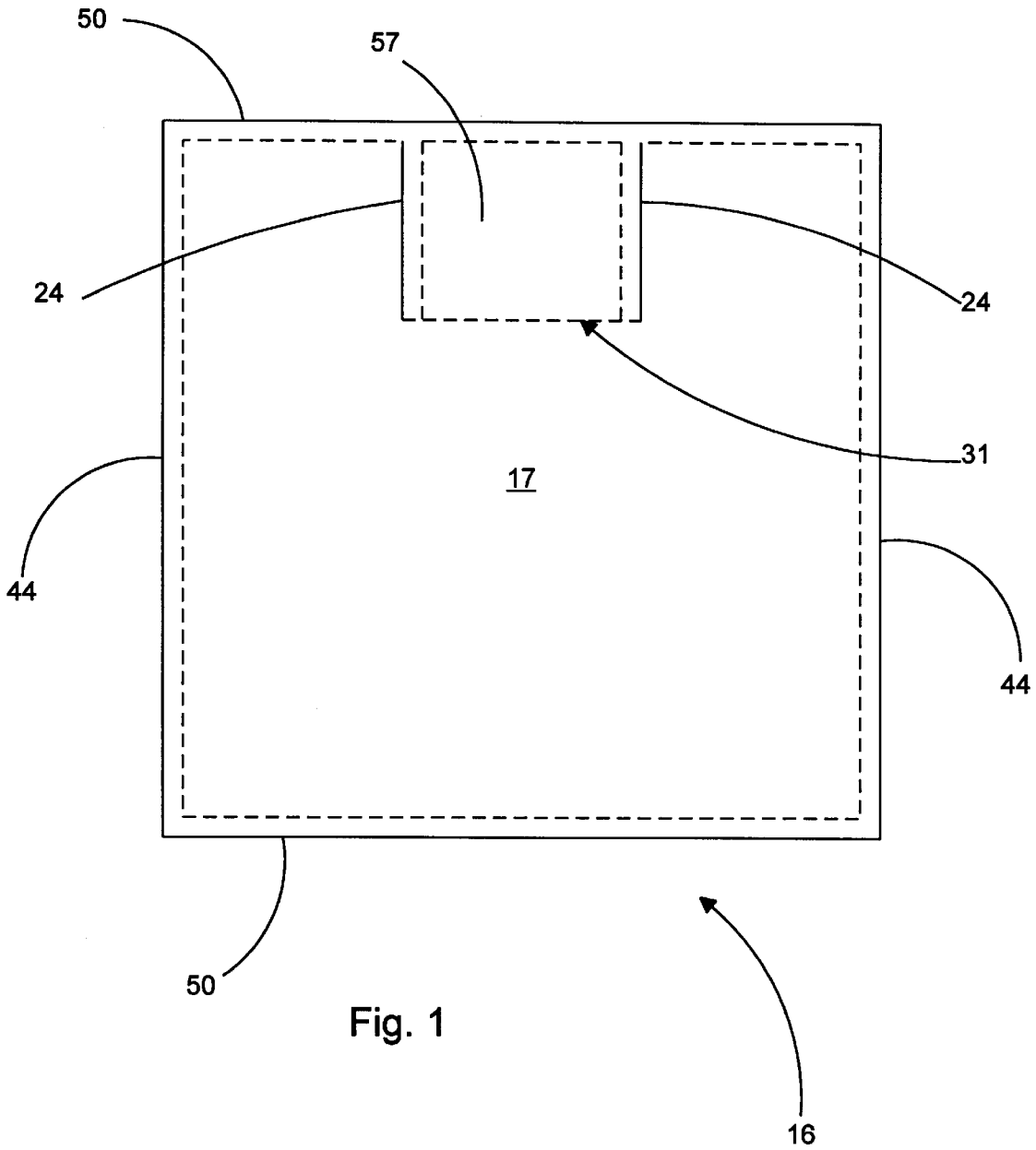
FIG. 1 is a front view showing the surface of the fabric garment which is external to the wearer when used as a body wrap. The hood is stored in its pocket and is not revealed in this figure.
Figure 4:
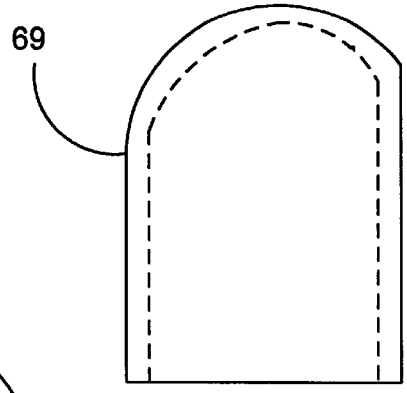
FIG. 4 is a truncated side view of the hood.

Referring to the drawings and initially to FIG. 1 there is illustrated a front view showing the outer surface 17 of the garment 16 having top and bottom length dimensions 50, and side dimensions 44, which outer surface 17 is external to the wearer when used as a body wrap. FIG. 1 depicts pillow pocket 57, having seams 24 disposed thereon, centrally located upon the top length dimension of the rectangular garment and sharing a seam with the edge of the top portion. Pillow pocket 57 is reversible, and has an opening 31 facing away from the top portion of the garment when the garment is extended, as shown. Located inside reversible pillow pocket 57 and stitched to seam 24 is handle means 28.

Figure 2:
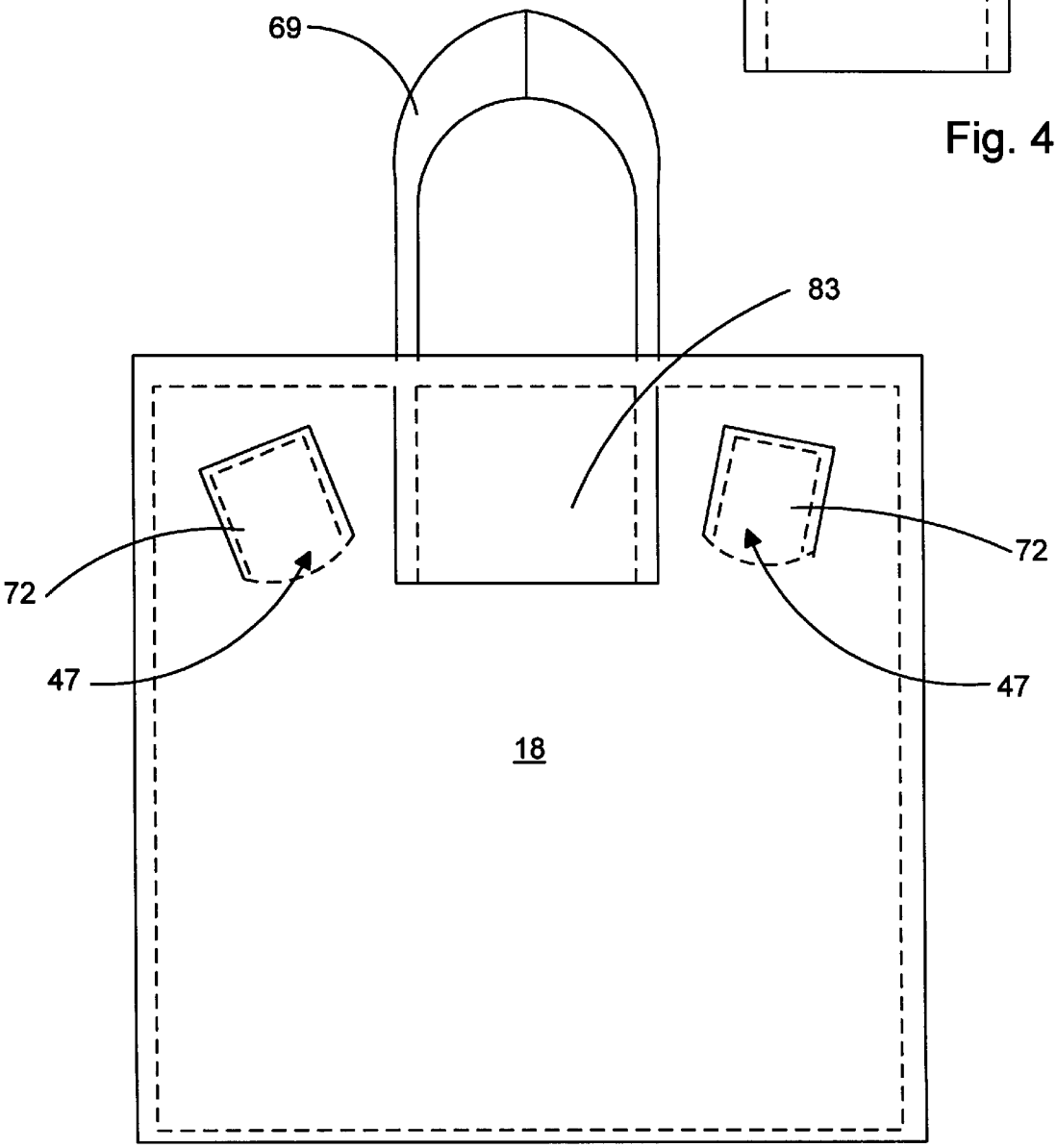
FIG. 2 is a back view showing the surface of the fabric garment which contacts the wearer when used as a body wrap. The hood is shown removed form its pocket.

FIG. 2 shows a back view of the surface of the garment which contacts the wearer when the garment is used as a body wrap, and depicts locations of hand pockets 72 having openings 47, hood pocket 83, and the hood portion 69 attached to the inner surface 18 of the garment 16. Hood portion 69 is attached at the same top edge as pillow pocket 57 in a central position along the top length dimension portion. Hood pocket 83 is located in such position that it is capable of receiving and containing hood portion 69 when the hood portion is folded or roiled up, and hence has an opening along the side coincident with the top length dimension of the garment. Hand pocket portions 72 are disposed about the inner surface 18 of the garment in such attitude as to be convenient, yet insulated grasping points for controlling the tightness of the garment asa whole about the body of the wearer, preferably through access of open portions 47 in the hand pockets which are conveniently oriented. Preferably, the pockets are approximately square in shape and are rotated at about 45 degrees with respect to the length dimension of the garment as a whole, although this offset is not critical to the synergistic functions of the garment. In another form of the invention (not shown), the hand pockets 72 are shaped in the form of a glove, having portions for receiving each of the fingers of the hand.

Figure 3:
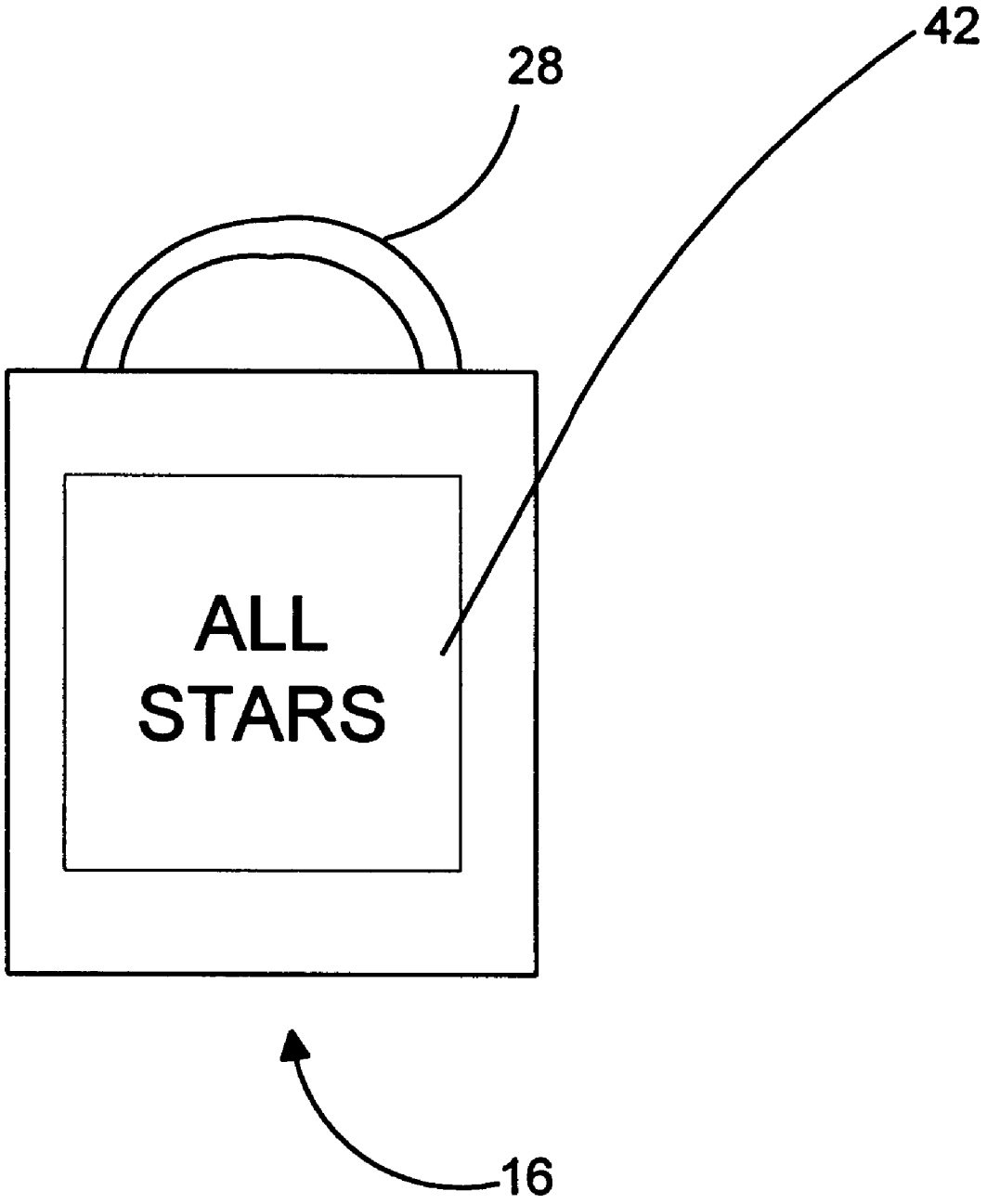
FIG. 3 is a folded view showing the appearance of the garment when in its folded position.

FIG. 3 shows the instant garment in its folded, compacted form, useful as a cushioning device, which conforms substantially to the surface dimensions of pillow pocket 57. In this figure are shown the handle means 28 used by the carrier of the garment, logo 42 showing various possible logos such as advertisements for soft drinks, names of sports teams, the owner of the garment, or any message or logo commonly seen on various items of clothing including advertising slogans, zodiac symbols, etc. From FIG. 3 it is evident that the garment may be reduced in size by folding according to the teachings set forth herein by a factor of about 3, that is—after compacting by folding the size of the garment is only about one-third of its size when filly extended for use as a blanket or body wrap.

To make the garment suitable for use as a hooded body wrap, one merely removes and unfolds all contents from pillow pocket 57, and then removes hood portion 69 from the hood pocket 83. Alternatively, this process may be undertaken without removing the hood portion from its pocket, in order to employ the garment in its blanket form.

In order to change the form of the garment from that of hooded body wrap to cushioning device, one merely folds the hood portion 69 to fit inside hood pocket 83. The garment is then laid out as shown in FIG. 1, and each edge of side dimensions 44 are folded inwards to coincide with seam 24 on pillow pocket 57 thus creating new creases in the fabric midway between seam 24 and edge 44. Each new crease is then folded over to coincide substantially with seam 24 which was initially furthest from each crease considered. Finally, the garment is folded from the bottom edge in order to make the bottom edge coincident with the location of the open portion of pillow pocket 57. The garment is folded once more, this time into the open portion of the pillow pocket 57. The garment is folded once more, this time into the open portion of the pillow pocket, thus producing a cushioning device sheathed by pillow pocket 57.

In order to change the form of the garment from that of hooded body wrap to the form most useful for transporting the garment, one merely folds the hood portion 69 to fit inside hood pocket 83. The garment is then laid out as shown in FIG. 1, and each edge of side dimension 44 is folded inwards to coincide with seam 24 on pillow pocket 57 thus creating new creases in the fabric midway between seam 24 and 44. Each new crease is then folded over to coincide substantially with seam 24 which was initially first from each crease considered. Then, the garment is folded in half from the bottom edge 50 in order to make the bottom edge coincident with the top edge. Finally, one inserts their hand into the pillow pocket and grasps the coinciding top and bottom edges and causes reversal of the reversible pillow pocket, thus tucking the entire garment within the pillow pocket and simultaneously exposing the handle means 28. There may be a logo or other indicia on the reversed inner (now exterior) surface of the pocket 57.

The exact fabric from which the invention may be comprised is not critical to the functioning of the invention, as it is believed that any fibrous material capable of being woven into a sheet or cloth is suitable. This includes without limitation, cotton, linen, rayon, wool, nylons, polyesters, canvas, silk, or blends thereof. However, the garment is preferably lined on the inner surface which contacts the wearer when used as a body wrap with a soft fiber lining, such as cotton, and preferably has as its outer surface when worn as a body wrap a wind-breaking and weather proof layer such as woven nylon NOMEX® material, KEVLAR® material.

Various fastening means may be employed at any location on the garment desired for convenience in securing either portions of the garment to itself, including but not limited to areas of hook-and-loop type fastening means.

Consideration must be given to the fact that although the present invention has been described and disclosed in relation to certain preferred embodiments, obvious equivalent modifications and alterations thereof will become apparent to one of ordinary skill in this art upon reading and understanding this specification and the claims appended hereto. Accordingly, the presently disclosed invention is intended to cover all such modifications and alterations, and is limited only by the scope of the claims which follow.

I claim:

1. A multi-purpose garment comprising:

an elongated, rectangular first sheet having:

an inside surface, an outside surface;

a pair of short sides; and a pair of long sides;

a hood having a bottom edge attached at a central position along one of the long sides of the first sheet;

a first pocket disposed on the inside of the first sheet and opening towards the hood at a central position along the one long side of the first sheet;

the first pocket positioned and sized to receive the hood folded therein;

a second pocket disposed on the outside of the first sheet and opening away from the hood at a central position along the one long side of the first sheet; and the second pocket sized to receive the first sheet folded therein.

2. The garment of claim 1 wherein the second pocket comprises a second sheet smaller than the first sheet secured along three sides to the outside of the first sheet, wherein both an inside and outside of the second sheet have a decorative insignia thereon.

3. The garment of claim 2 wherein the decorative insignia is selected from the group consisting of: advertising slogans, sports team names, and logos.

4. The garment of claim 1 wherein the second pocket comprises a second sheet smaller than the first sheet secured along three sides to the outside of the first sheet, wherein a handle is secured inside the second pocket along one of the three sides.

5. The garment of claim 1 further comprising a pair of hand-sized pockets disposed on the inside of the first sheet near comers thereof at opposite ends of the one long side, wherein the hand-sized pockets are in opposing positions on opposite sides of the hood and the first pocket.

6. The garment of claim 1 wherein the first sheet comprises a multi-layer fabric composite.

7. The garment of claim 5 wherein the multi-layer fabric composite comprises a layer of insulating fabric and a layer of weather-breaking fabric.

8. The garment of claim 6 wherein the insulating fabric comprises a fiber selected from the group consisting of: cotton, linen, rayon, polyester, wool, and blends thereof.

9. The garment of claim 7 wherein the weather-breaking fabric comprises a materials selected from the group consisting of: nylon, NOMEX, KEVLAR, and polyester.

10. The garment of claim 1 wherein the first sheet compiles a single layer fabric material.

11. The garment of claim 1 wherein the first sheet comprises a cloth blanket.

12. A process for transforming a multi-purpose fabric garment from utility as a body wrap to utility as a cushioning device which comprises:

providing a garment with an elongated, rectangular first sheet having an inside surface, an outside surface, a pair of short sides and a pair of long sides;

having a hood with a bottom edge attached at a central position along one of the long sides of the first sheet;

disposing a first pocket on the inside of the first sheet and opening towards the hood at a central position along the one long side of the first sheet;

positioning and sizing the first pocket to receive the hood folded therein;

disposing a second pocket on the outside of the first sheet and opening away from the hood at a central position along the one long side of the first sheet; sizing the second pocket to receive the first sheet folded therein; and causing the first sheet to fit in the second pocket.

13. The process of claim 12 wherein the hood is caused to reside in the first pocket prior to when the first sheet is caused to fit into the second pocket.

* * * * *